US006072937A

United States Patent [19]

Benade et al.

[11] Patent Number: 6,072,937

[45] Date of Patent: Jun. 6, 2000

[54] STEAM GENERATOR

[76] Inventors: Ludwick Jacobus Benade, 19 Platinum Street, Goedeburg, Benoni; Zacharias Blomerus, 20 Fouche Avenue, Pomona Ext. 3, Kempton Park, both of South Africa

[21] Appl. No.: 09/018,913

[22] Filed: Feb. 5, 1998

[30] Foreign Application Priority Data

Feb. 5, 1997 [ZA] South Africa ..... 97/0935

[51] Int. Cl.[7] ..... F22B 1/30; F24H 7/02

[52] U.S. Cl. ..... 392/336; 392/338; 392/327

[58] Field of Search ..... 392/336, 311, 392/324, 333, 338, 331, 326, 329

[56] References Cited

U.S. PATENT DOCUMENTS

| | | | |
|---|---|---|---|
| 1,954,248 | 4/1934 | Kaelin . | |
| 3,617,698 | 11/1971 | Duncanson | 219/284 |
| 3,619,559 | 11/1971 | Camp | 219/288 |
| 3,654,428 | 4/1972 | Talge et al. | 219/288 |
| 3,892,945 | 7/1975 | Lerner | 219/437 |
| 4,146,775 | 3/1979 | Kirchner et al. | 219/295 |
| 4,262,191 | 4/1981 | Lepper et al. | 219/497 |
| 4,394,561 | 7/1983 | Zerbel | 219/285 |
| 4,430,555 | 2/1984 | Stokes | 219/286 |
| 4,439,669 | 3/1984 | Ryffel . | |
| 4,496,826 | 1/1985 | Osrow . | |
| 4,692,591 | 9/1987 | Cooley et al. | 219/295 |
| 4,730,098 | 3/1988 | Cave | 219/291 |
| 5,025,132 | 6/1991 | Fortmann et al. | 219/401 |
| 5,384,888 | 1/1995 | Peng | 392/336 |
| 5,771,336 | 6/1998 | Polny | 392/321 |

FOREIGN PATENT DOCUMENTS

| | | |
|---|---|---|
| 0 490 014 | 6/1992 | European Pat. Off. . |
| 420 140 | 10/1925 | Germany . |
| 195 470 | 4/1928 | United Kingdom . |
| 617 877 | 2/1949 | United Kingdom . |
| 2 196 820 | 5/1988 | United Kingdom . |

*Primary Examiner*—Tu Ba Hoang
*Assistant Examiner*—Daniel Robinson
*Attorney, Agent, or Firm*—Burns, Doane, Swecker & Mathis, L.L.P.

[57] ABSTRACT

A steam generator comprises a chamber having an inlet for water and an outlet for steam. Disposed in the chamber are first and second sets of interleaved electrodes, connected to respective poles of an electrical supply. The electrodes have tapered planar surfaces extending adjacent one another, with a cross sectional area which increases in a direction away from the inlet for water. The electrodes also have multiple apertures formed in the planar surfaces. The chamber is tapered complementally to the shape of the electrodes, and is mounted within a primary reservoir. The inlet for water is in liquid communication with the interior of the primary reservoir and the level of the liquid in the primary reservoir is maintained constant.

12 Claims, 3 Drawing Sheets

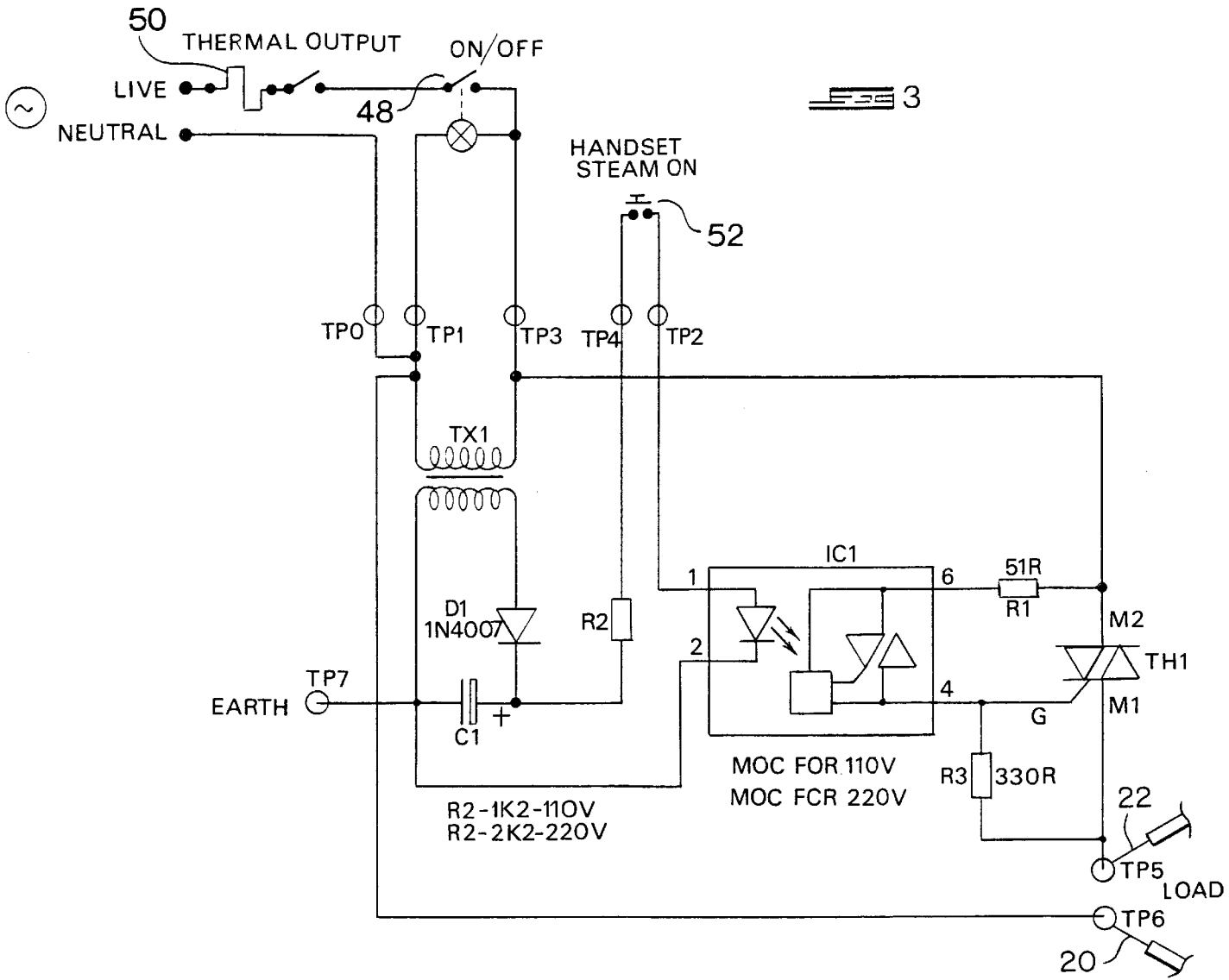
3
50
THERMAL OUTPUT
LIVE
NEUTRAL
ON/OFF
48
HANDSET
STEAM ON
52
TP0
TP1
TP2
TP3
TP4
TX1
D1
1N4007
C1
R2
R2-1K2-110V
R2-2K2-220V
TP7
EARTH
IC1
1
2
4
6
MOC FOR 110V
MOC FCR 220V
51R
R1
M2
M1
G
TH1
330R
R3
22
TP5
LOAD
TP6
20

STEAM GENERATOR

BACKGROUND TO THE INVENTION

This invention relates to a steam generator.

Steam generators comprising a pair of electrodes which are immersed in water are known for various applications. For example, humidifiers are known which operate on this principle, as well as steamers which can be used to remove creases from clothing.

Known steamers tend to require a significant length of time to boil sufficient water to create steam, which can be frustrating for a user.

It is an object of the invention to provide a steam generator which operates relatively rapidly.

SUMMARY OF THE INVENTION

According to the invention a steam generator comprises a chamber having an inlet for water, an outlet for steam, and at least two electrodes disposed side by side in the chamber, at least two adjacent electrodes having planar surfaces extending adjacent one another, with a plurality of apertures being formed in the planar surfaces.

Preferably a plurality of first electrodes are interleaved with a plurality of second electrodes, the first and second electrodes being connected to respective poles of an electrical supply.

The electrodes preferably comprise perforated metallic plates.

The electrodes may be tapered, having a cross section which increases in a direction away from first ends thereof adjacent the inlet for water towards second ends thereof adjacent the outlet for steam.

The chamber is preferably tapered complementary to the shape of the electrodes.

The chamber is preferably mounted within a primary reservoir, the inlet for water being in liquid communication with the interior of the primary reservoir and the level of the liquid in the primary reservoir being maintained constant.

Preferably, a secondary reservoir is provided within its interior in liquid communication with the interior of the primary reservoir.

The secondary reservoir may comprise a removable, portable liquid container with an outlet adapted to be located within or adjacent an inlet of, the primary reservoir.

BRIEF DESCRIPTION OF THE DRAWINGS

FIG. 3 is a schematic circuit diagram of an electronic control circuit of the steam generator.

DESCRIPTION OF EMBODIMENTS

Figure 2:
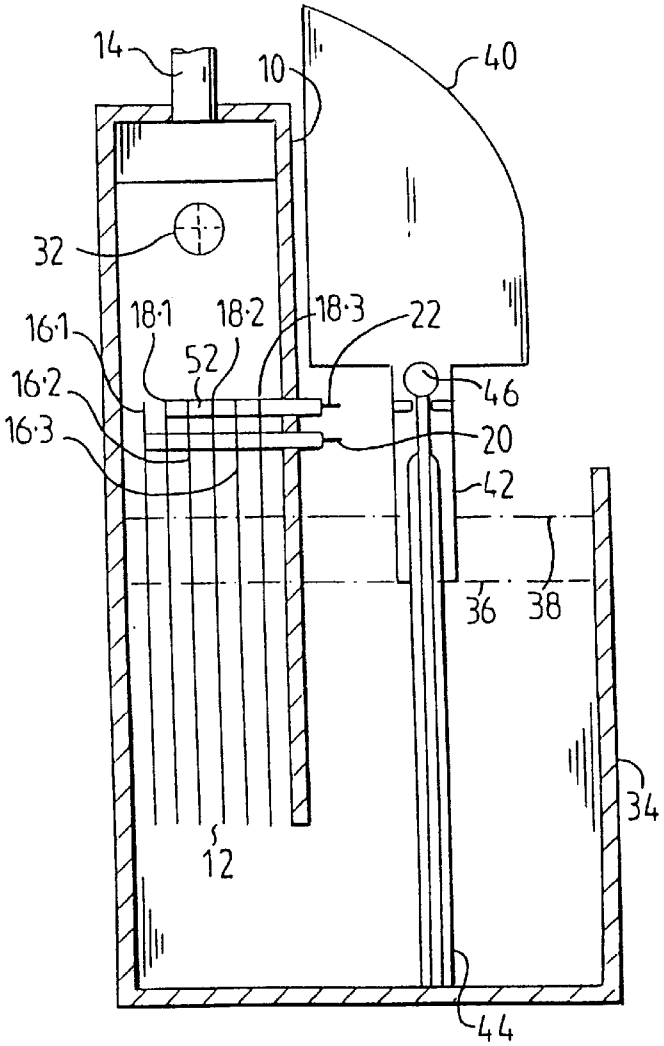
FIG. 2 is a schernatic sectional side view on the line 2—2 in FIG. 1.

The illustrated steam generator was designed to form part of a wall mounted steamer with a flexible hose for use in steaming clothes. However, it will be appreciated that the steam generator of the invention could be used in numerous other applications.

Referring now to the drawings, the illustrated steam generator comprises a steam chamber 10 which has a choked inlet 12 at its lowermost end and a steam outlet 14 at its uppermost end to which will normally be connected a flexible tube or pipe to convey steam to a point of application. The steam chamber is constructed from a heat resistant, non-conductive material such as mineral filled polypropylene. As can best be seen in FIG. 1, the steam chamber tapers towards the inlet 12 to define a tapered zone 12*a*.

Within the steam chamber 10, in the tapered portion thereof, are two sets of metallic plates 16 which are interleaved as best seen in FIG. 2 and which function as the electrodes of the steam generator. Three plates 16.1, 16.2 and 16.3 are connected to a first electrical contact 20, while three interleaved plates 18.1, 18.2 and 18.3 are connected to a second electrical contact 22. The contacts 20 and 22 are connected to an electrical source in use, via a control circuit (shown in FIG. 3). The separation between the adjacent plates is approximately 3 mm.

The shape of the plates 16 and 18 is such that active, lower portions of the plates are triangular in shape. Those lower portions are tapered complementary to the taper of the tapered zone 12*a*. The plates 16 and 18 are in fact identical, with the plates 18 merely being rotated through 180° relative to the plates 16, so that their respective mounting apertures 24 are spaced apart from one another on either side of a central axis 26 of the electrode structure.

Each of the plates 16 and 18 is perforated with a number of circular apertures 28. These apertures prevent the build-up of excessive pressure between adjacent plates when the steam generator is operating, and thus prevent boiling water from being expelled upwardly from between the plates into the splash room 30 defined above the plates by the steam chamber 10. This prevents boiling water from entering the outlet 14 in use, which is an important safety feature.

The plates 16 and 18 of the prototype steam generator were formed from stainless steel. The apertures 28 in the prototype were 3 mm in diameter.

Figure 1:
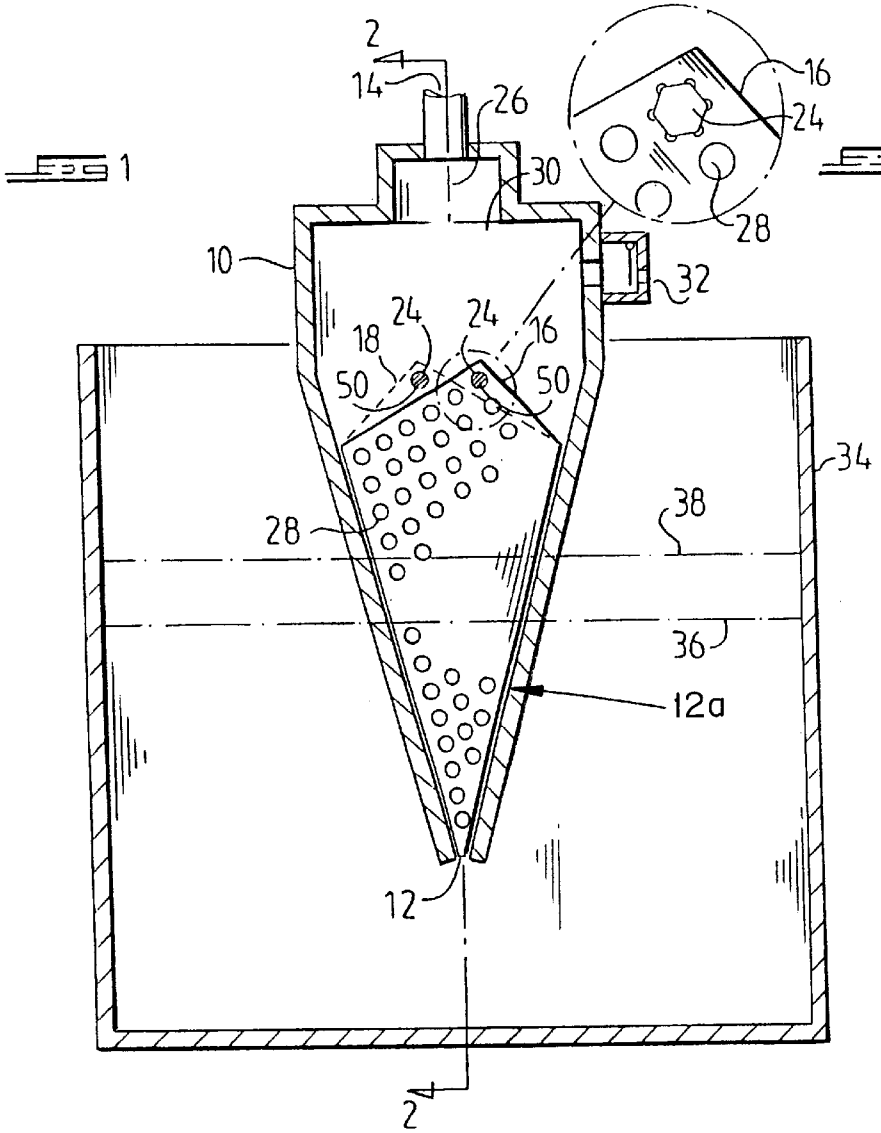
FIG. 1 is a schematic sectional front view of a steam generator according to the invention.

As seen in the enlarged detail of FIG. 1, the mounting apertures 24 of the plates 16 and 1 8 are hexagonal in shape, allowing them to be fitted to a hexagonal rod 50 between insulating spacers 52. The ends of the rods 50 are threaded so that the electrode assemblies can be held together by means of nuts at each end of the rods.

The upper portion 10 of the chamber is fitted with a relief valve 32 which releases the pressure in the chamber if the outlet 14 becomes blocked for any reason.

Depending on the main supply voltage on which the steam generator is intended to be operated, the appropriate water level within the chamber 10 is determined by the level of water within a reservoir 34, with a lower level 36 being suitable for use on a 220 volt main supply, and an upper level 38 being suitable for use on a 110 volt main supply.

The circuit diagram of FIG. 3 shows the electronic control circuitry of the prototype steam generator apparatus, which was incorporated in a clothes steaming device having a handset or nozzle connected to the outlet of the steam generator by a flexible hose. The control circuit is designed for connection to an AC main supply, and has a main on/off switch 48 in series with a thermal cutout 50. When closed, the on/off switch 48 connects the main supply to the primary of a step-own transformer TX1, the secondary of which is used to provide a low voltage DC power supply, using a rectifier diode D1 and a reservoir capacitor C1. This power supply is used to drive a light emitting diode in an optically coupled triac-based power controller IC1, via a current limiting resistor R2 and a push button switch 52 in the handset of the clothing steamer. This ensures that the user of the steamer is not exposed to main voltages.

The power controller IC1 has an output which is connected to the gate of a triac TH1 which applies main current to the steam generator (load).

Figure 4:
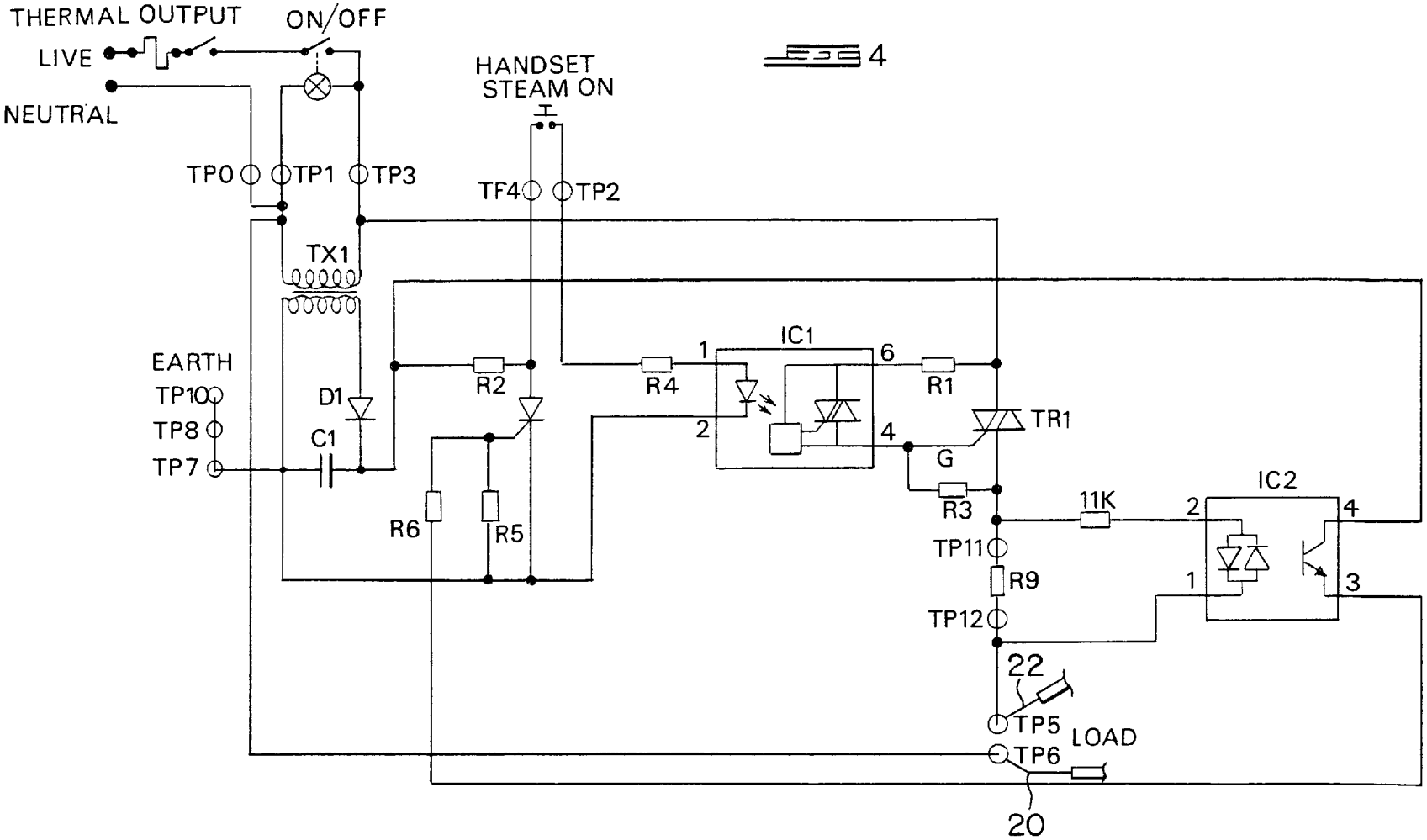
FIG. 4 is a schematic circuit diagram of an alternative electronic control circuit of the steam generator.

Arcing between the electrode plates is a potential problem in a device of the kind described and therefore a current sensing circuit may be included to provide protection by means of instant current cut-off during arcing. A current sensing circuit is included in the alternative electronic control circuitry illustrated in FIG. 4. Referring to this Figure, the current to the electrode plates is sensed as a voltage across a shunt resistor R2 floating on the main potential. The resistor R2 consists of a specified length of nickel-chrome wire coiled around a plastic core. This resistor assembly is situated inside the water reservoir below the water level to facilitate cooling thereof. The sensed voltage switches the bidirectional LED on in an optically current coupled device, through a current limiting resistor R8, isolating the mains supply though the internal transistor back to the low voltage control circuit. The transistor output voltage represents a current to the electrode plates which drives the gate of an SCR (TH2). The SCR latches when its gate voltage exceeds a predetermined voltage (0.6 V for the prototype) through two resistors R6 and R5, which determine a preset trigger point. This latch condition cuts the supply to the LED's in IC1, and the latch condition is maintained until reset by switching the main unit off and back on through a switch SW48.

The water level in the reservoir 34 is determined by a water tank or container 40 which has an outlet tube 42 depending therefrom which is sized to fit over an upstanding pillar 44 in the reservoir 34. Within the tubular outlet 42 of the tank 40 is a ball valve 46 which is opened by engagement with the tip 48 of the pillar 44 when the tank is seated on the pillar in use. The level of the water in the reservoir 34 is then determined by the length of the outlet 42. This makes it possible to cater for different operating voltages by simply providing water tanks 40 with outlets of differing lengths, with the rest of the steam generator apparatus being substantially identical in either case. The ball valve 46 allows the tank 40 to be filled with water under a tap by a user, and prevents spilling of water when the tank is inverted and placed in position over the pillar 44.

In use, cold water enters the steam chamber through the small opening defined by the inlet 12 at the bottom of the chamber. This small opening functions as a choke, preventing water from rushing in or out of the steam chamber, and thus allowing a controlled build-up of pressure in the chamber. It also isolates the chamber from the cold water in the reservoir 34.

When the steam generator is operated, an electric current passes between adjacent plates 16 due to the conductivity of the water, resulting in the boiling of the water. The conductivity of the water reduces when it boils, due to the formation of steam bubbles in the water. However, as the water boils it is pushed up between the plates, exposing a progressively larger surface area of the plates to the water. The increased contact area of the plates compensates for the lower conductivity of the boiling water, thus keeping the operating current more or less constant.

When water with a relatively high level of conductivity is used, the boiling action becomes more vigorous, resulting in a higher pressure inside the steam chamber. This higher pressure expels water from the chamber via the choke opening at the bottom, lowering the water level in the chamber and again helping to keep the operating current more or less current.

In the event of a total blockage of the outlet 14, for example due to a blockage of the hose or nozzle connected thereto, the relief valve 32 operates to release excessive pressure within the steam chamber. Without the relief valve, cold water will enter the chamber under these conditions, causing a sudden collapse of the steam column inside the hose, which will result in the chamber and hose being filled with cold water from the reservoir.

Due to the natural movement of the water in the chamber and reservoir during use, the build-up of solid material on the plates 16 is very low. Any solids in suspension will drop out and settle on the floor of the reservoir, which is preferably inclined, and can be drained from time to time.

A prototype of the steam generator reached operating temperature and generated a strong flow of steam from the outlet 14 within approximately 5 to 10 seconds from being started, using water at room temperature. When started subsequently, steam generation is almost instantaneous, due to the retention of heated water within the steam chamber 10. Steam generation is rapid due to the very small volume of water which has to be boiled.

We claim:

1. A steam generator comprising:

a chamber having an inlet for water and a outlet for steam; and a plurality of electrodes disposed side-by-side in the chamber, at least two electrodes having planar surfaces extending adjacent one another, with a plurality of apertures being formed in the planar surfaces;

wherein the chamber is tapered towards the inlet to define a tapered zone, and the electrodes are tapered in the tapered zone, complemental to the taper of the chamber to promote rapid generation of steam.

2. A steam generator according to claim 1, wherein at least two electrodes comprise a plurality of first electrodes interleaved with at least a second electrode, the first and second electrodes being connectable to respective poles of an electrical supply.

3. A steam generator according to claim 2, wherein a plurality of first electrodes are interleaved with a plurality of second electrodes.

4. A steam generator according to claim 1, wherein the adjacent planar surfaces of the electrodes have substantially the same shape.

5. A steam generator according to claim 3, wherein each electrode has a mounting aperture and wherein each electrode of the plurality of first and second interleaved electrodes is rotated through 180 degrees with respect to adjacent electrodes so the mounting apertures of adjacent electrodes are spaced apart from one another about a central axis of the plurality of electrodes.

6. A steam generator according to claim 1 wherein the electrodes comprise perforated metallic plates.

7. A steam generator according to claim 1 wherein the chamber is mounted within a primary reservoir, the inlet for water being in liquid communication with the interior of the primary reservoir and the level of the liquid in the primary reservoir being maintained constant.

8. A steam generator according to claim 7, wherein the level of the liquid in the primary reservoir can be varied to compensate for different electrical supply voltages.

9. A steam generator according to claim 8 further comprising a secondary reservoir, with its interior in liquid communication with the interior of the primary reservoir.

10. A steam generator according to claim 9, wherein the secondary reservoir comprises a removable, portable liquid container with an outlet adapted to be located within, or adjacent an inlet of, the primary reservoir.

11. A steam generator according to claim 1 including a control circuit arranged to control the current between the electrodes in use.

12. A steam generator according to claim 11 wherein the control circuit includes current sensing means arranged to detect arcing between the electrodes, and switch means responsive to the current sensing means to clamp the electrode current when arcing is detected.

* * * * *

UNITED STATES PATENT AND TRADEMARK OFFICE
CERTIFICATE OF CORRECTION

PATENT NO. : 6,072,937

DATED : June 6, 2000

INVENTOR(S) : Ludwick Jacobus BENADE et al.

It is certified that error appears in the above-identified patent and that said Letters Patent is hereby corrected as shown below:

On the title page:

Insert the assignee data as follows:

-- [73] IRENCO (PROPRIETARY) LIMITED, Centurion, South Africa --

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*